US005897298A

United States Patent [19]

Umemura

[11] Patent Number: 5,897,298

[45] Date of Patent: Apr. 27, 1999

[54] VARIABLE DISPLACEMENT SWASH PLATE TYPE COMPRESSOR WITH SUPPORTING PLATE FOR THE PISTON RODS

[75] Inventor: Yukio Umemura, Yokohama, Japan

[73] Assignee: Calsonic Corporation, Tokyo, Japan

[21] Appl. No.: 08/659,213

[22] Filed: Jun. 5, 1996

[30] Foreign Application Priority Data

Jun. 5, 1995 [JP] Japan ..... 7-137773

[51] Int. Cl.[6] ..... F04B 1/26

[52] U.S. Cl. ..... 417/222.2; 417/269; 92/71

[58] Field of Search ..... 417/264, 222.2; 92/71

[56] References Cited

U.S. PATENT DOCUMENTS

| | | | |
|---|---|---|---|
| 2,590,573 | 3/1952 | Rinia | 74/60 |
| 3,817,660 | 6/1974 | Knowles et al. | 417/269 |
| 3,838,942 | 10/1974 | Pokorny | 417/269 |
| 5,201,261 | 4/1993 | Kayukawa et al. | 92/71 |
| 5,292,236 | 3/1994 | Graffin | 417/510 |
| 5,336,056 | 8/1994 | Kimura et al. | 417/222.1 |
| 5,364,232 | 11/1994 | Kimura et al. | 417/222.1 |
| 5,380,166 | 1/1995 | Terauchi | 417/269 |
| 5,549,032 | 8/1996 | Long | 91/502 |
| 5,588,807 | 12/1996 | Kimura | 417/222.2 |
| 5,615,599 | 4/1997 | Terauchi | 92/165 R |
| 5,681,150 | 10/1997 | Kawaguchi | 417/222.2 |

FOREIGN PATENT DOCUMENTS

| | | |
|---|---|---|
| 0 318 316 | 5/1989 | European Pat. Off. . |
| 2937412 | 9/1979 | Germany . |
| 41 39 186 | 6/1992 | Germany . |
| 43 33 408 | 5/1994 | Germany . |
| 57-12105 | 1/1982 | Japan . |
| 64-1668 | 1/1989 | Japan . |
| 64-53477 | 4/1989 | Japan . |

*Primary Examiner*—Timothy S. Thorpe
*Assistant Examiner*—Ehud Gartenberg
*Attorney, Agent, or Firm*—Foley & Lardner

[57] ABSTRACT

A variable displacement swash plate type compressor has a plurality of cylinders circumferentially arranged in a casing thereof. It includes a device for achieving a smooth axial movement of each piston in the cylinder while suppressing a rotational movement of the piston about an axis thereof. This device includes a cylindrical piston rod that extends from an eccentric portion of a piston head of each piston and a supporting plate tightly installed in the casing. The supporting plate has a circular opening through which the piston rod of each piston slidably passes.

7 Claims, 5 Drawing Sheets

VARIABLE DISPLACEMENT SWASH PLATE TYPE COMPRESSOR WITH SUPPORTING PLATE FOR THE PISTON RODS

BACKGROUND OF THE INVENTION

1. Field of the Invention

The present invention relates in general to compressors for use in an automotive air conditioning system or the like, and more particularly to compressors of a variable displacement swash plate type.

2. Description of the Prior Art

In FIG. 3, there is diagrammatically shown an air cooling section of a common automotive air conditioning system.

Designated by numeral 1 is a compressor which compresses a refrigerant vapor supplied thereto. The compressed refrigerant vapor from the compressor 1 is supplied to a condenser 2 to be condensed by carrying out a heat exchange with the surrounding air. The condensed or liquefied refrigerant from the condenser 2 is supplied, through a liquid tank 3 and an expansion valve 4, to an evaporator 5 where the refrigerant is subjected to evaporation to cool air which is flowing through the evaporator 5. The cooled air is fed to a passenger cabin of the vehicle. The refrigerant thus heated and vaporized at the evaporator 5 is then supplied to the compressor 1 for repeating the cooling cycle.

As the compressor 1, variable displacement swash plate type compressors are known, which can vary the displacement by changing the inclination angle of a swash plate installed therein.

In order to clarify the task of the present invention, one of the conventional compressors of such type will be described with reference to FIGS. 4 and 5 of the accompanying drawings, which is disclosed in Japanese Patent Second Provisional Publication 64-1668.

As shown in FIG. 4, the conventional compressor 1 comprises a cylindrical casing 6. The casing 6 includes a cylindrical casing proper 7 whose axial open ends are respectively closed by a head case 8 and an end cover 9. Although not shown in the drawing, a plurality of bolts are used for assembling the casing 6.

Within the head case 8, there are defined a low pressure chamber 10 and a high pressure chamber 11. Of course, pressure in the high pressure chamber 11 is higher than that of the low pressure chamber 10. A partition plate 15 is air-tightly interposed between the casing proper 7 and the head case 8. The head case 8 is formed with an inlet port 12*a* which is communicated with the low pressure chamber 10. The head case 8 is further formed with an outlet port 12*b* which is communicated with the high pressure chamber 11. The inlet port 12*a* is connected to an outlet port of the above-mentioned evaporator 5 (see FIG. 3), and the outlet port 12*b* is connected to an inlet port of the condenser 2 (see FIG. 3).

A drive shaft 13 is coaxially arranged in the casing 6, which passes through the end cover 9. An inner end of the drive shaft 13 is arranged in a center bore 26 defined in the casing proper 7. Two radial needle bearings 22*a* and 22*b* and two thrust bearings 23*a* and 23*b* are used for permitting smooth rotation of the drive shaft 13 in the casing 6. As shown, the radial needle bearings 22*a* and 22*b* directly bear the drive shaft 13 at the center bore 26 and the end cover 9, while, the thrust bearings 23*a* and 23*b* indirectly bear the drive shaft 13 at the center bore 26 and the end cover 9. That is, the thrust bearings 23*a* and 23*b* are arranged to bear a certain thrust load applied to the drive shaft 13.

The thrust bearing 23*a* is installed in a stepped portion 25 of the center bore 26 to support an inner end of the drive shaft 13. The thrust bearing 23*a* is biased leftward in the drawing by an adjusting nut 24 which is meshed with a threaded inner wall of the center bore 26. That is, by turning the adjusting nut 24, an axial force applied to the drive shaft 13 can be adjusted.

The other thrust bearing 23*b* is interposed between the end cover 9 and an after-mentioned supporting bracket 20.

Within a right half of the casing 6, there are defined a plurality (five or six) of cylinders 14 which are arranged at evenly spaced intervals about an axis of the drive shaft 13. Each cylinder 14 has a piston 16 slidably received therein.

Within a left half of the casing 6, there is defined a crank chamber 18. In the crank chamber 18, a sleeve member 19 having a spherical outer surface 19*a* is slidably disposed on the drive shaft 13. A supporting bracket 20 is secured to the drive shaft 13 to rotate therewith. As shown, a base part of the supporting bracket 20 is positioned near the end cover 9 to put the thrust bearing 23*b* therebetween. A coil spring 21 is disposed about the drive shaft 13 to be compressed between the sleeve member 19 and the supporting bracket 20. Thus, the sleeve member 19 is biased rightward, that is, toward the cylinders 14. A stop ring 28 is secured to the drive shaft 13 near the center bore 26 to stop excessive rightward movement of the sleeve member 19. Thus, so long as an after-mentioned swash plate 27 has no external force applied thereto, the sleeve member 19 is forced to take its rightmost position as shown in FIG. 5 wherein the sleeve member 19 abuts against the stop ring 28. In this condition, an inclination angle "θ" defined by the swash plate 27 and an imaginary plate perpendicular to the axis of the drive shaft 13 is small.

The swash plate 27 is pivotally connected to the spherical sleeve member 19. That is, for this pivotal connection, a center spherical bore 27*a* formed in the swash plate 27 is slidably disposed on the spherical outer surface 19*a* of the sleeve member 19. The swash plate 27 is provided at a side facing the supporting bracket 20 with a driven arm 31 which has a guide pin 32 connected thereto.

The supporting bracket 20 is formed with a drive arm 29 which projects toward the swash plate 27. The drive arm 29 has a slanting elongate slot 30 through which the guide pin 32 of the driven arm 31 passes. Due to this arrangement, the swash plate 27 is permitted to pivot within the angular range "θ" determined by the distance moved by the pin 32 in the slot 30. In accordance with a sliding movement of the sleeve member 19 on and along the drive shaft 13, the swash plate 27 is pivoted about the guide pin 32.

That is, as is shown in FIG. 4, when the sleeve member 19 comes close to the supporting bracket 20 against the force of the coil spring 21, the guide pin 32 comes to the radially outer end of the elongate slot 30 causing the swash plate 27 to pivot about the sleeve member 19 in a direction to increase the inclination angle "θ". Under this condition, the stroke of each piston 16 is increased and thus the displacement of the compressor 1 is increased.

While, when the sleeve member 19 moves away from the supporting bracket 20 with an aid of the force of the coil spring 21, the guide pin 32 moves toward the radially inward end of the elongate slot 30 causing the swash plate 27 to pivot in a direction to decrease the inclination angle "θ", as shown in FIG. 5. Under this condition, the stroke of each piston 16 is decreased and thus the displacement of the compressor 1 is decreased.

As shown, each piston 16 is provided at a leading end of a stem portion 34 thereof with a shoe holder portion 33. The shoe holder portion 33 holds a pair of shoes 17 and 17 between which a peripheral part of the swash plate 27 is slidably interposed. Each shoe 17 comprises a flat inner surface which slidably contacts the swash plate 27 and a spherical outer surface which is intimately disposed in a spherical recess 35 formed in the shoe holder portion 33. Upon assembly of the two shoes 17 and 17, the two spherical outer surfaces of them constitute a part of an outer surface of a single sphere.

The stem portion 34 of each piston 16 has a guided outer surface which is guided by a guide structure 36 formed on an inner surface of the casing proper 7. That is, due to provision of the guided outer surface and the guide structure 36, an axial movement of the piston 16 is smoothly carried out and an undesired rotary movement of the piston 16 about the axis thereof is suppressed.

In accordance with the pivotal movement of the swash plate 27 under rotation thereof about the axis of the drive shaft 13, the stem portion 34 pushes and pulls the piston 16 into and from the corresponding cylinder 14.

The partition plate 15 is formed with an inlet bore 37 through which the low pressure chamber 10 and each cylinder 14 are communicated. The partition wall 15 is further formed with an outlet bore 38 through which the high pressure chamber 11 and each cylinder 14 are communicated. An inlet valve 39 of reed type is associated with the inlet bore 37 for permitting only inlet flow of a refrigerant vapor into the cylinder 14 from the low pressure chamber 10. An outlet valve 40 of reed type is associated with the outlet bore 38 for permitting only outlet flow of a highly compressed refrigerant vapor into the high pressure chamber 11 from the cylinder 14.

Between the low pressure chamber 10 and the crank chamber 18, there extends a pressure regulating passage 41. Within the passage 41, there is arranged a pressure regulating valve 45. The pressure regulating valve 45 comprises a bellows 42 which effects a telescopic motion in accordance with a surrounding pressure applied thereto and a needle 44 which is fixed to a top of the bellows 42 to close and open an orifice 43 in accordance with the telescopic motion of the bellows 42. The bellows 42 is filled with a gas of predetermined pressure. In accordance with the refrigerant pressure in the low pressure chamber 10, the pressure regulating valve 45 controls the communication between the crank chamber 18 and the low pressure chamber 10 thereby adjusting the pressure in the crank chamber 18.

In the following, operation of the above-mentioned conventional compressor 1 will be described.

When, for operating the cooling section of the automotive air conditioning system, the drive shaft 13 is driven, the swash plate 27 is rotated together with the drive shaft 13 while making "helical turns" about the axis of the shaft 13. Due to the spiral turns of the swash plate 27, each piston 16 is forced to make reciprocating movement in the corresponding cylinder 14, and thus, the refrigerant vapor from the evaporator 5 (see FIG. 3) is sucked into the cylinders 14 through the inlet port 12*a*, the inlet bores 37 and the inlet valves 39. After being compressed by the pistons 16 in the cylinders 14, the refrigerant vapor is discharged to the high pressure chamber 11 through the outlet bores 38 and the outlet valves 40. The compressed refrigerant vapor in the high pressure chamber 11 is then supplied to the condenser 2 (see FIG. 3).

Under a severe cooling load, it is necessary to compress a larger amount of refrigerant vapor. In this case, the pressure of the refrigerant vapor fed from the evaporator 5 (see FIG. 3) to the low pressure chamber 10 is relatively high, and thus, the pressure in the pressure regulating passage 41 is high. Under this condition, the bellows 42 of the pressure regulating valve 45 is contracted causing the needle 44 to move away from the orifice 43 of the passage 41. As a result, the crank chamber 18 becomes in communication with the low pressure chamber 10 through the orifice 43 and the passage 41, and thus the pressure in the crank chamber 18 is lowered.

During operation of the compressor 1, the pressure in the crank chamber 18 applies to a back face of each piston 16 and the pressure in a compression chamber of the corresponding cylinder 14 applies to a front face of the piston 16. Accordingly, each piston 16 is pressed toward a lower pressure side with a force corresponding to the pressure difference therebetween. Such forces applied to all the pistons 16 are added to determine the inclination angle of the swash plate 27. Of course, the pressure in the compression chamber of each cylinder 14 is subjected to change during the reciprocating movement of the piston 16. However, since such reciprocating movement is carried out at a high speed, it is considered that the pressure in the compression chamber is the average of various degree of pressure continuously produced in the stroke.

When, as is stated hereinabove, the pressure in the crank chamber 18 is lowered and the pressure becomes very low as compared with the pressure in each compression chamber of the cylinder 14, the force for pressing each piston 16 leftward, that is, toward the swash plate 27 is increased. As is mentioned hereinabove, the guide pin 32 for the swash plate 27 is arranged at a radially outer side with respect to the drive shaft 13. Accordingly, the moment applied to the swash plate 27 differs in every piston 16. That is, the moment of pistons 16 positioned close to the guide pin 32 is small and the moment of pistons 16 positioned away from the guide pin 32 is large. Accordingly, when the pressure in the crank chamber 18 is low, the swash plate 27 is largely inclined as shown in FIG. 4. That is, the inclination angle "θ" is increased. Under this condition, each piston 16 is forced to have a long stroke, and thus, the displacement of the compressor 1 is increased.

Under a lower cooling load, it is only necessary to compress a smaller amount of refrigerant vapor. In this case, the pressure of the refrigerant vapor fed from the evaporator 5 is relatively low, and thus, the pressure regulating passage 41 is low. Under this condition, the bellows 42 is expanded causing the needle 44 to move into the orifice 43 to close the same. As a result, the crank chamber 18 becomes isolated from the low pressure chamber 10. In this state, the pressure in the crank chamber 18 is gradually increased due to penetration of high pressure refrigerant vapor (or blowby gas) thereinto through a clearance between each piston 16 of the cylinder 14.

When, as is stated hereinabove, the pressure in the crank chamber 18 is increased and the pressure becomes higher than that in each compression chamber of the cylinder 14, the force for pressing each piston 16 leftward, that is, toward the swash plate 27 is lowered. Accordingly, the swash plate 27 is moved rightward due to the force of the coil spring 21 and inclined slightly as shown in FIG. 5. That is, the inclination angle "θ" is decreased. Under this condition, each piston 16 is forced to have a short stroke, and thus, the displacement of the compressor 1 is lowered.

Under a medium cooling load, the pressure regulating valve 45 regulates the pressure in the crank chamber 18 at a medium level. In this case, the swash plate 27 shows a posture between the posture of FIG. 4 and that of FIG. 5.

However, due to inherent construction, the above-mentioned conventional compressor 1 has the following drawbacks.

(1) Machining both the guide structure 36 on the inner surface of the casing proper 7 and the guided outer surface on each piston 16 needs a very troublesome and expensive technique, which thus increases the production cost of the compressor 1.

(2) Due to presence of a clearance inevitably defined between the guide structure 36 and the guided outer surface, a slight but assured pivoting of each piston 16 about its axis is produced under operation of the compressor 1. However, this pivoting tends to cause a collision of the guided outer surface against the guide structure 36, which produced a marked noise.

SUMMARY OF THE INVENTION

It is therefore an object of the present invention to provide a variable displacement swash plate type compressor which is free of the above-mentioned drawbacks.

According to a first aspect of the present invention, there is provided a variable displacement swash plate type compressor which comprises a casing having a plurality of cylinders circumferentially arranged therein; a plurality of pistons incorporated with the cylinders respectively; a drive shaft extending in the casing; a swash plate axially movably disposed on the drive shaft and inclinable relative to the same; means for causing the swash plate to make helical turns when the drive shaft is rotated; means for making a hinged and slidable connection between the swash plate and each of the pistons to make a reciprocative movement of each piston when the drive shaft is rotated; and a structure for achieving a smoothed axial movement of each piston in the cylinder while suppressing a rotational movement of the piston about an axis thereof, the structure including a cylindrical piston rod which extends from an eccentric portion of a piston head of each piston; and a supporting plate fixed positioned in the casing, the supporting plate having a circular opening through which the piston rod of each piston slidably passes.

According to a second aspect of the present invention, there is provided a variable displacement swash plate type compressor which comprises a cylindrical casing having a plurality of cylinders circumferentially arranged therein; a plurality of pistons incorporated with the cylinders respectively, each piston including a piston head slidably disposed in the corresponding cylinder, a cylindrical piston rod extending from an eccentric part of the piston head and a swash plate holding portion formed at a leading end of the piston rod; a drive shaft coaxially extending in the casing; a swash plate axially movably disposed on the drive shaft and inclinable relative to the same; means for causing the swash plate to make helical turns about the axis of the drive shaft when the drive shaft is rotated about the axis; means for slidably connecting the swash plate holding portion with a periphery of the swash plate thereby to make a reciprocating movement of each piston when the swash plate makes the helical turns; a coil spring disposed about the drive shaft to bias the swash plate toward the cylinders; and a supporting plate fixedly positioned in the casing in a manner to define a crank chamber in which the swash plate, the coil spring and the swash plate holding portion are placed, the supporting plate having circular openings through which the cylindrical piston rods of the pistons slidably pass respectively, wherein a center axis of the piston rod of each piston is positioned radially outside of that of a corresponding cylinder with respect to a longitudinal axis of the drive shaft.

According to a third aspect of the present invention, there is provided a variable displacement swash plate type compressor which comprises a cylindrical casing having a plurality of cylinders circumferentially arranged therein; a plurality of pistons incorporated with the cylinders respectively, each piston including a piston head slidably disposed in the corresponding cylinder, a cylindrical piston rod extending from an eccentric part of the piston head and a swash plate holding portion formed at a leading end of the piston rod; a drive shaft coaxially extending in the casing; a swash plate axially movably disposed on the drive shaft and inclinable relative to the same; means for causing the swash plate to make helical turns about the axis of the drive shaft when the drive shaft is rotated about the axis; means for slidably connecting the swash plate holding portion with a periphery of the swash plate thereby to make a reciprocating movement of each piston when the swash plate makes the helical turns; a first coil spring disposed about the drive shaft to bias the swash plate toward the cylinders; a second coil spring disposed about the drive shaft to bias the swash plate in a direction away from the cylinders; and a supporting plate fixedly positioned in the casing in a manner to define a crank chamber in which the swash plate, the swash plate holding portion and the first and second coil springs are placed, the supporting plate having circular openings through which the cylindrical piston rods of the pistons slidably pass respectively, wherein a center axis of the piston rod of each piston is positioned radially outside of that of a corresponding cylinder with respect to a longitudinal axis of the drive shaft.

BRIEF DESCRIPTION OF THE DRAWINGS

Other objects and advantages of the present invention will become apparent from the following description when taken in conjunction with the accompanying drawings, in which.

DETAILED DESCRIPTION OF THE EMBODIMENTS

Figure 1:
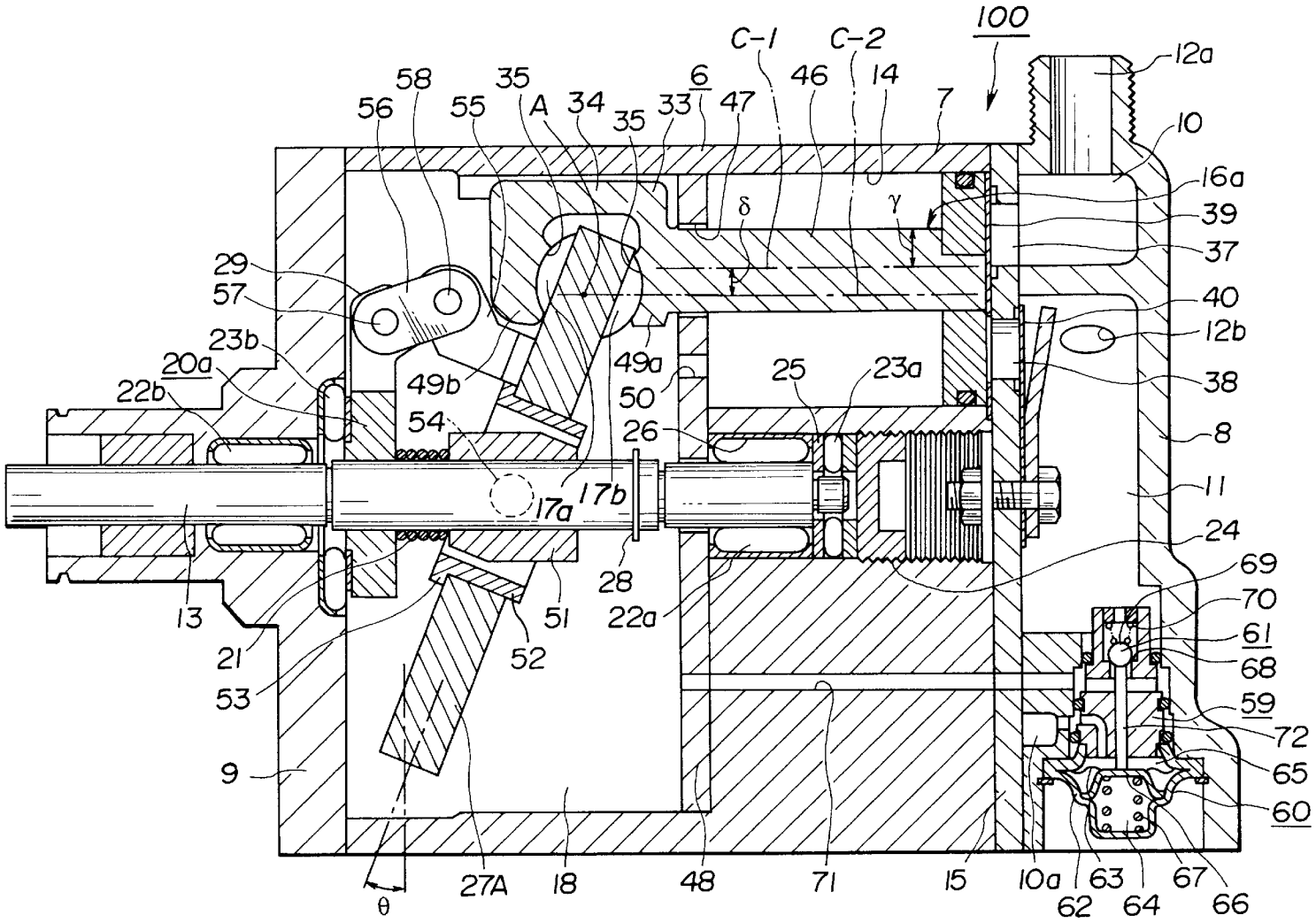
FIG. 1 is a sectional view of a variable displacement swash plate type compressor which is a first embodiment of the present invention.

Referring to FIG. 1, there is shown a variable displacement swash plate type compressor 100 which is a first embodiment of the present invention.

For ease, detailed description of parts substantially the same as those of the above-mentioned conventional compressor 1 will be omitted from the following and such parts are designated by the same numerals. That is, parts and construction which are different from those of the conventional one 1 will be described preponderantly in the following.

The compressor 100 comprises a cylindrical casing 6 which includes a cylindrical casing proper 7 whose axial open ends are respectively closed by a head case 8 and an end cover 9. For simplicity of the drawing, gaskets disposed between mated surfaces of the parts are not shown in the drawing.

In this first embodiment 100, pistons 16*a* having unique shape are used. That is, each piston 16*a* has a cylindrical piston rod 46 which extends rearward from an eccentric part of a piston head (no numeral), as shown.

For the purpose which will become apparent hereinafter, each piston 16*a* is of a split type which can be divided into one part which forms the piston head and the other part which forms the piston rod 46 and a shoe holder portion 33. These two parts are united through a so-called press fitting technique, as shown in the drawing. If desired, the two parts may be united through a so-called screw connection.

Designated by "C-1" is a center axis of the piston rod 46, which is eccentric to a center axis "C-2" of a corresponding cylinder 14 by a distance of "δ". The center axis "C-2" passes through a center "A" of an imaginary sphere defined by the spherical outer surfaces of the two shoes 17*a* and 17*b*.

It is to be noted that the distance of "δ" is smaller than the radius "γ" of the piston rod 46. Thus, the center axis "C-2" of the cylinder 14 (and of the piston head) lies in the piston rod 46, as shown. Accordingly, a thrust load applied to the piston 16*a* based on the pressure in the compression chamber of the cylinder 14 is effectively supported by the piston rod 46.

If the center axis "C-2" of the cylinder 14 lies outside of the piston rod 46, a certain force based on the thrust load is applied to the rod 46 in the direction perpendicular to the axis "C-2". The force causes a marked increase in contact pressure and thus friction between the inner wall of an after-mentioned supporting opening 47 and an outer surface of the piston rod 46. Furthermore, the force causes a marked increase in bending stress applied to the piston rod 46. However, these drawbacks are solved in the present invention due to the above-mentioned reasons.

Referring back to FIG. 1, a supporting plate 48 is fixedly positioned in a front end of the crank chamber 18. The supporting plate 48 is formed, at each portion mated with a rear open end of the corresponding cylinder 14, with both a circular supporting opening 47 and a smaller communication opening 50. As shown, the supporting opening 47 has the piston rod 46 slidably disposed therein, and the communication opening 50 provides a communication between the crank chamber 18 and the interior of the cylinder 14 (more specifically, the interior of a chamber isolated from the compression chamber of the cylinder 14). Due to the nature of a split construction, each piston 16*a* can be easily received in the supporting opening 47 of the supporting plate 48. Of course, the center of the supporting opening 47 is eccentric to the center axis "C-2" of the cylinder 14 by a distance of "δ", like in the case of the piston rod 46.

Due to provision of the supporting opening 47 formed in the above-mentioned manner, axial movement of each piston 16*a* in the cylinder 14 is smoothly achieved, and due to the eccentric arrangement of the piston rod 46 relative to the supporting opening 47, the piston 16*a* is assuredly suppressed from making undesired rotation about its center axis "C-2".

It is to be noted that machining such supporting plate 48 and putting the same to the set position do not need a troublesome and expensive technique.

During operation of the compressor 100, the piston 16*a* is applied with a certain force in a direction perpendicular to the axis of a drive shaft 13, and thus, the piston rod 16*a* is pressed against one half part of the rounded wall of the supporting opening 47. However, since this pressing is made between large contact areas of them, the piston 16*a* can move smoothly with a smaller friction force generated therefrom.

Referring back to FIG. 1, a cylindrical sleeve member 51 is slidably disposed on a drive shaft 13 in the crank chamber 18 and a supporting bracket 20*a* is secured to the drive shaft 13 to rotate therewith. A coil spring 21 disposed on the drive shaft 13 is compressed between the sleeve member 51 and the supporting bracket 20*a*, as shown. The sleeve member 51 is provided with aligned pins 54 which extend radially outward. Pivotally supported by the pins 54 is an annular holder ring 52 which has a swash plate 27A tightly disposed thereon. Thus, like in the case of the above-mentioned conventional compressor 1, the swash plate 27A is movable along the drive shaft 13 and pivotal to the same.

The annular holder ring 52 is formed with a flange 53 against which a rear face of the swash plate 27A abuts. Thus, a thrust load applied from the pistons 16*a* to the swash plate 27A is received by the annular holder ring 52 through the flange 53. The swash plate 27A is provided at a side facing the supporting bracket 20*a* with a driven arm 55.

The supporting bracket 20*a* is formed with a drive arm 29 which projects outward. The drive arm 29 and the driven arm 55 are pivotally connected through a link 56. That is, the link 56 has one end pivotally connected to the drive arm 29 through a pin 57 and the other end pivotally connected to the driven arm 55 through another pin 58. With this link mechanism, the swash plate 27A is permitted to make the sliding and pivotal movement relative to the drive shaft 13.

That is, when the sleeve member 51 comes close to the supporting bracket 20*a* against the force of the coil spring 21, the swash plate 27A is pivoted about the pins 54 in a direction to increase the inclination angle "θ". Under this condition, the stroke of each piston 16*a* is increased and thus the displacement of the compressor 100 is increased.

While, when the sleeve member 51 moves away from the supporting bracket 20*a* with an aid of the coil spring 21, the swash plate 27A is pivoted about the pins 54 in a direction to decrease the inclination angle "θ". Under this condition, the stroke of each piston 16*a* is decreased and thus the displacement of the compressor 100 is decreased. It is to be noted that even when the sleeve member 51 comes into contact with the stop ring 28, the pin 58 is located outside of the pin 27. Thus, sliding of the sleeve member 51 along the drive shaft 13 can induce the pivoting of the swash plate 27A assuredly. Furthermore, usage of the link 56 and the pins 57 and 58 for the pivotal connection between the supporting bracket 20*a* and the swash plate 27A can minimize a noise inevitably produced when the swash plate 27A moves relative to the supporting bracket 20*a*.

In the first embodiment, for varying the displacement of the compressor 100, a fluid communication between the crank chamber 18 and a high pressure chamber 11 is controlled. For this control, there is installed in a head case 8 a pressure regulating valve 59, which controls the fluid communication between the crank chamber 18 and the high pressure chamber 11 in accordance with the pressure in a low pressure chamber 10. Although not shown in the drawing, there extends a restricted passage between the crank chamber 18 and the low pressure chamber 10 for gradually transferring a higher pressure in the crank chamber 18 to the low pressure chamber 10. However, when the pressure regulating valve 59 is kept OPEN, the amount of refrigerant led from the high pressure chamber 11 to the crank chamber 18 is greater than that led from the crank chamber 18 to the low pressure chamber 10 and thus the pressure in the crank chamber 18 is increased.

The pressure regulating valve 59 comprises a diaphragm type actuator 60 and a valve proper 61 actuated by the actuator 60. The actuator 60 comprises a case 62 whose interior is divided into two chambers 64 and 65 by a diaphragm 63. The chamber 64 is communicated with the atmospheric air. The chamber 65 (which will be referred to as pressure induction chamber hereinafter) is communicated with the low pressure chamber 10 through a small passage 10*a*. A push plate 66 is fixed to a center of the diaphragm 63 to move therewith. A coil spring 67 is compressed in the chamber 64 to bias the push plate 66 (and thus the diaphragm 63) toward the pressure induction chamber 65. Accordingly, when the pressure in the low pressure chamber 10 is relatively high, the push plate 66 is shifted toward the atmospheric chamber 64 against the force of the coil spring 67, while, when the pressure in the lower pressure chamber 10 is relatively low, the push plate 66 is shifted toward the pressure induction chamber 65 with an aid of the force of the spring 67.

The valve proper 61 comprises a valve seat 68 installed in the high pressure chamber 11, a ball 69 facing the valve seat 68 and a coil spring 70 biasing the ball 69 toward the valve seat 68. The spring constant of the spring 70 is quite smaller than that of the above-mentioned spring 67. When the ball 69 is kept away from the valve seat 68, the high pressure chamber 11 and the crank chamber 18 is communicated through a passage 71, while, when the ball 69 is put on the valve seat 68, such communication is blocked.

Between the ball 69 and the push plate 66 of the diaphragm 63, there extends a push rod 72 which is fixed to the push plate 66. When, due to a higher pressure in the low pressure chamber 10 and thus in the pressure induction chamber 65, the push plate 66 is greatly shifted toward the atmospheric chamber 64, the push rod 72 does not press the ball 69 and the ball 69 is pressed against the valve seat 68 due to the force of the spring 70. While, due to a lower pressure in the low pressure chamber 10 and thus in the chamber 65, the push plate 66 is shifted toward the pressure induction chamber 65 due to the force of the spring 67, the push rod 72 presses the ball 69 against the force of the spring 70. In this case, the ball 69 is separated from the valve seat 68.

In the following, operation of the compressor 100 will be described.

Figure 3:
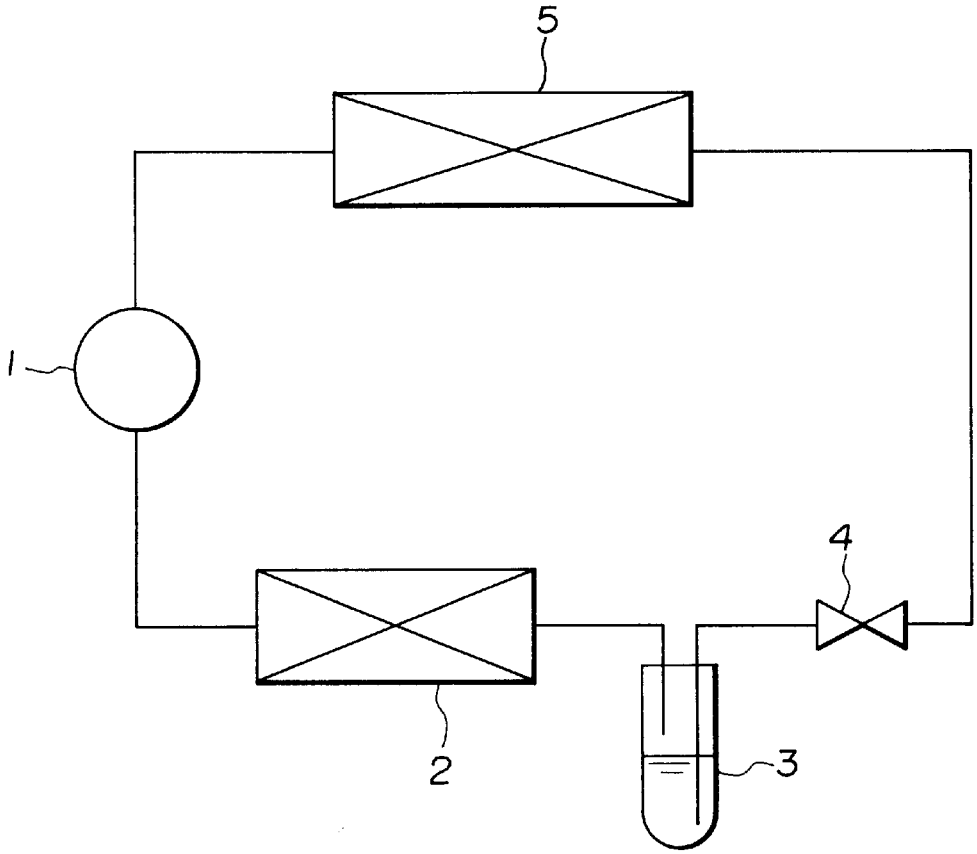
FIG. 3 is a diagrammatic view of an air cooling section of a common automotive air conditioning system.
Figure 4:
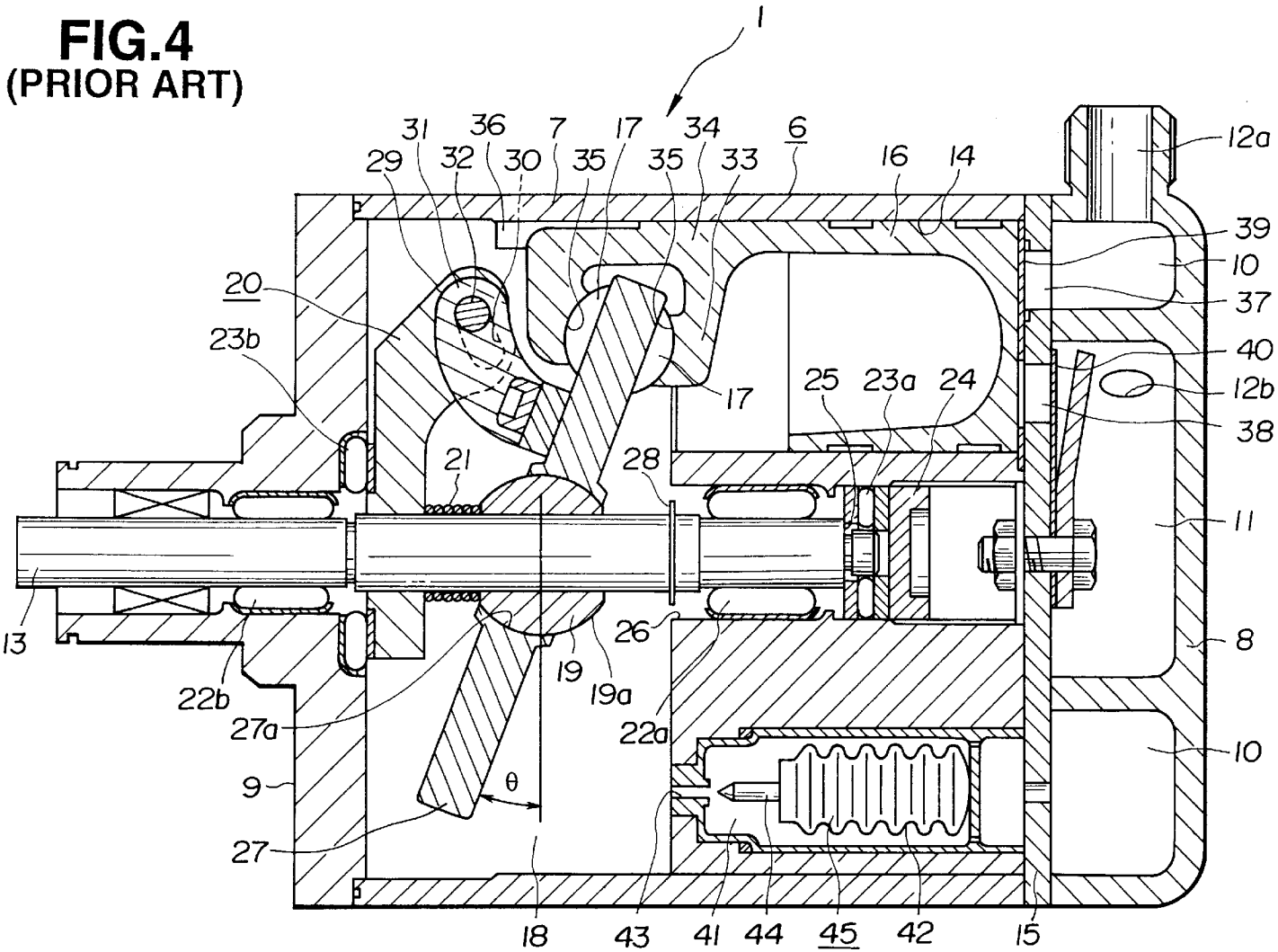
FIG.4 (PRIOR ART)
FIGS. 4 and 5 are sectional views of a conventional variable displacement swash plate type compressor, respectively showing different conditions of the same.
Figure 5:
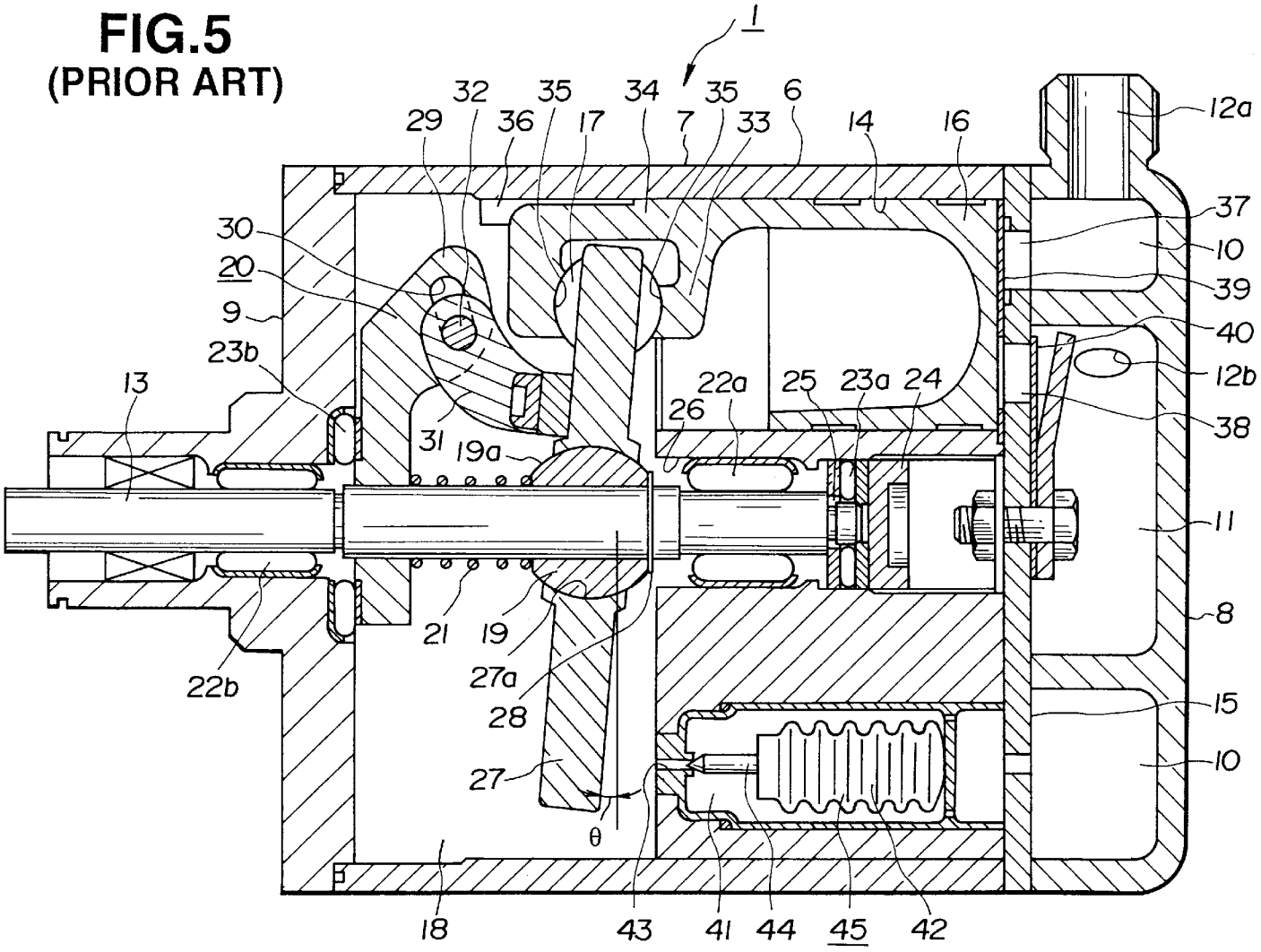
FIG.5 (PRIOR ART)

When the drive shaft 13 is driven, the swash plate 27A is rotated about the axis of the shaft 13 while making "helical turns" like in the case of the above-mentioned conventional compressor 1. Due to the spiral turns of the swash plate 27A, each piston 16*a* is forced to make reciprocating movement in the corresponding cylinder 14, and thus, the refrigerant vapor led into the low pressure chamber 10 is sucked into the cylinders 14 through the inlet bores 37 and the inlet valves 39. After being compressed in the cylinders 14 by the pistons 16*a*, the refrigerant vapor is discharged to the high pressure chamber 11 through the outlet bores 38 and the outlet valves 40. The compressed refrigerant vapor in the high pressure chamber 11 is then supplied to the condenser 2 (see FIG. 3).

Under a severe cooling load, it is necessary to compress a larger amount of refrigerant vapor. In this case, the pressure of the refrigerant vapor fed to the low pressure chamber 10 is relatively high, and thus, the pressure in the pressure induction chamber 65 is high. Under this condition, the push rod 72 does not push the ball 69 and thus the communication between the high pressure chamber 11 and the crank chamber 18 through the passage 71 is blocked. Accordingly, feeding of compressed refrigerant from the high pressure chamber 11 to the crank chamber 18 is no longer carried out, and thus the pressure in the crank chamber 18 becomes low. In this case, the swash plate 27A is largely inclined as shown in FIG. 1. That is, the inclination angle "θ" is increased, and thus, the displacement of the compressor 100 is increased.

Under a lower cooling load, it is only necessary to compress a smaller amount of refrigerant vapor. In this case, the pressure of the refrigerant vapor fed to the low pressure chamber 10 is relatively low, and thus, the pressure in the pressure induction chamber 65 is low. Under this condition, the push rod 72 pushes the ball 69 away from the valve seat 68 and thus the communication between the high pressure chamber 11 and the crank chamber 18 through the passage 71 is established. Accordingly, the compressed refrigerant in the high pressure chamber 11 is fed back to the crank chamber 18 thereby increasing the pressure in the crank chamber 18. In this case, the swash plate 27A is slightly inclined. That is, the inclination angle "θ" is decreased, and thus, the displacement of the compressor 100 is lowered.

As is described hereinabove, in this first embodiment, the higher pressure in the high pressure chamber 11 is used for controlling the pressure in the crank chamber 18. This brings about a quick and reliable change of the displacement of the compressor 100. That is, for increasing the pressure in the crank chamber 18, the sufficiently pressurized refrigerant vapor in the high pressure chamber 11 is used, and thus, the pressure in the crank chamber 18 can be increased to a given level shortly, While, in case of the above-mentioned conventional compressor 1, a low pressure refrigerant vapor from the evaporator 5 is used for increasing the pressure in the crank chamber 18, which takes time.

As is described hereinabove, in the first embodiment, the supporting plate 48 for the pistons 16*a* is used and each piston 16*a* has an eccentric piston rod 46 supported by the supporting plate 48. Thus, axial movement of the piston 16*a* in the cylinder 14 is smoothly made, and the piston 16*a* is assuredly suppressed from making rotational movement about the axis thereof.

In the following, modifications of the compressor 100 of the first embodiment will be described with reference to FIG. 1.

First, if desired, an electric actuator may be arranged in parallel with the above-mentioned pneumatically operated actuator 60 for much instantly bringing out OPEN condition of the pressure regulating valve 59. That is, if, upon requirement of rapid acceleration of an associated motor vehicle, the electric actuator is energized, the higher pressure in the high pressure chamber 11 is instantly fed back to the crank chamber 18 through the passage 71. With this, the displacement of the compressor 100 is lowered instantly thereby instantly lowing a load applied to the engine by the compressor 100.

Second, if desired, the cylinders 14 may be somewhat inclined with respect to the drive shaft 13. That is, due to the nature of the pivotal connection between each piston 16*a* and the swash plate 27A by using the shoes 17*a* and 17*b*, smoothed movement of the pistons 16*a* is carried out even if such inclination is present.

Third, if desired, one side shoes 17*a* positioned near the end cover 9 may be sized small in comparison with the other side shoes 17*b*. That is, a load applied to the shoes 17*a* under movement of the pistons 16*a* is smaller than that applied to the other shoes 17*b*. In this case, one holding arm 49*b* of the shoe holder portion 33 can be reduced in size as is indicated by a phantom line "α" in the drawing. This is very advantageous in reducing the size and weight of the compressor 100.

Figure 2:
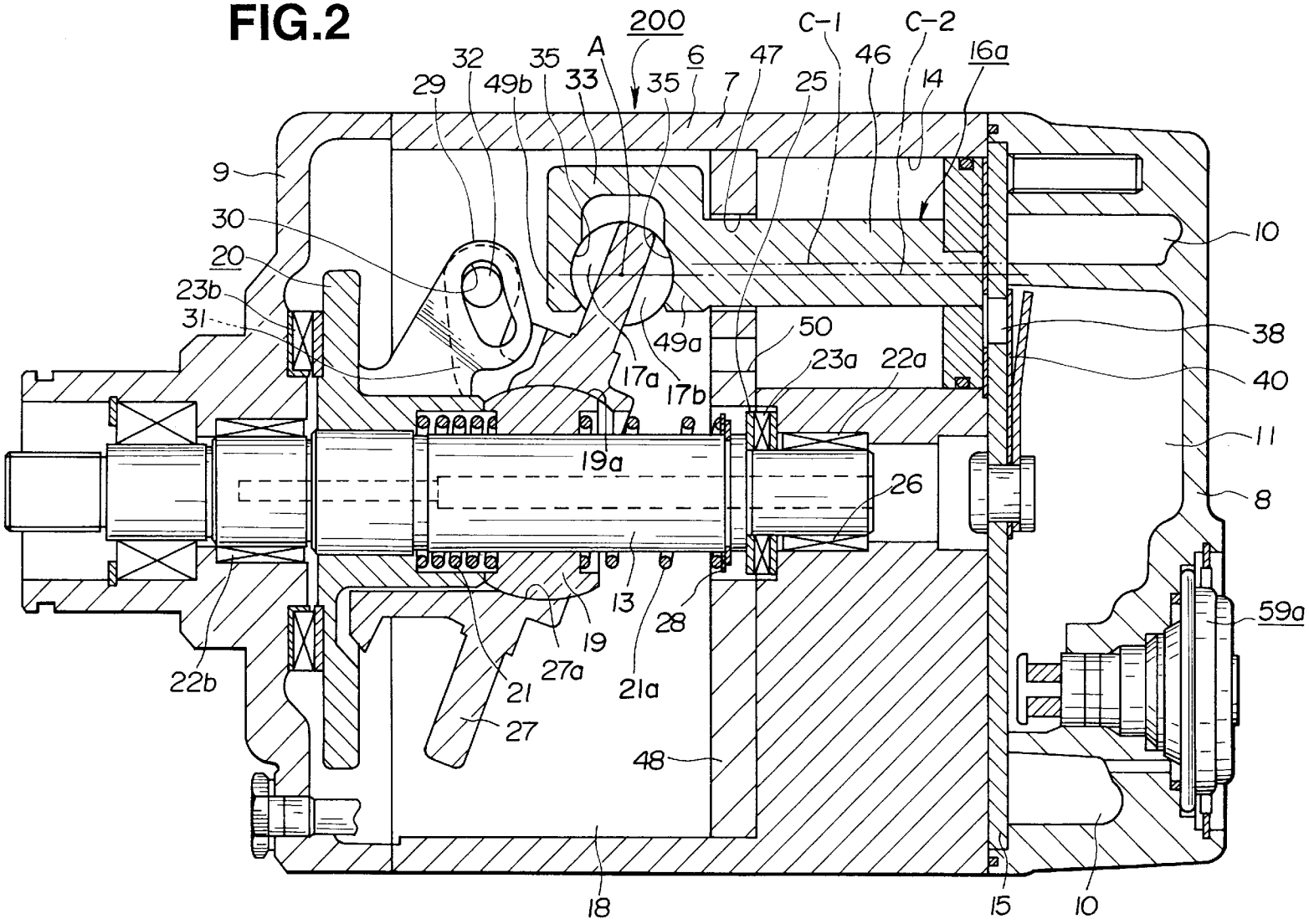
FIG. 2 is a view similar to FIG. 1, but showing a second embodiment of the present invention.

Referring to FIG. 2, there is shown a variable displacement swash plate type compressor 200 which is a second embodiment of the present invention.

The compressor 200 of this embodiment is substantially the same as the above-mentioned conventional compressor 1 except some parts which will be described in the following. The substantially same parts are denoted by the same numerals.

In the second embodiment 200, a supporting plate 48 for the pistons 16*a* is employed like in the case of the above-mentioned first embodiment 100.

Each piston 16*a* has an eccentric piston rod 46 which passes through an eccentric supporting opening 47 of the supporting plate 48, like in the case of the first embodiment 100.

A coil spring 21*a* is compressed between the sleeve member 19 and the stop ring 28.

A pressure regulating valve 59*a* similar to the valve 59 of the first embodiment 100 is installed in the head case 8.

Due to usage of the supporting plate 48 for supporting the pistons 16*a*, the axial movement of each piston 16*a* in the cylinder 14 is smoothly made. Furthermore, due to the eccentric piston rod 46 possessed by each piston 16*a*, undesired rotational movement of the piston is assuredly suppressed, like in the first embodiment 100.

What is claimed is:

1. A variable displacement swash plate type compressor comprising:

a casing having a plurality of cylinders circumferentially arranged therein;

a plurality of pistons incorporated with the cylinders respectively;

a drive shaft extending in said casing;

a swash plate axially movably disposed on said drive shaft and inclinable relative to the same;

means for causing said swash plate to wobble when said drive shaft is rotated;

means for making a hinged and slidable connection between the swash plate and each of the pistons to reciprocate each piston when the drive shaft is rotated; and a device for achieving a smoothed axial movement of each piston in the cylinder while suppressing a rotational movement of the piston about an axis thereof, said device including:

a cylindrical piston rod which extends from an eccentric portion of a piston head of each piston; and a supporting plate fixedly positioned in said casing, said supporting plate having a circular opening through which said piston rod of each piston slidably passes, wherein a center axis of the piston rod of each piston is positioned radially outside of a center axis of a corresponding cylinder with respect to a longitudinal axis of the drive shaft to prevent the piston rod from rotating.

2. A variable displacement swash plate type compressor as claimed in claim 1, in which said supporting plate has further an opening through which a crank chamber in which said swash plate is installed is communicated with a rear chamber defined in the cylinder behind the piston head.

3. A variable displacement swash plate type compressor as claimed in claim 2, in which said supporting plate is so arranged as to close the rear chambers of the cylinders.

4. A variable displacement swash plate type compressor as claimed in claim 3, further comprising:

a low pressure chamber which is communicated with an intake port;

an inlet valve operatively arranged between said low pressure chamber and a compression chamber of each cylinder;

a high pressure chamber which is communicated with an outlet port;

an outlet valve operatively arranged between said high pressure chamber and said compression chamber of each cylinder;

means for making a fluid communication between said high pressure chamber and said crank chamber; and means for controlling said fluid communication in accordance with the pressure in said low pressure chamber.

5. A variable displacement swash plate type compressor as claimed in claim 1, in which said piston is of a split type which can be divided into one part which forms a piston head and the other part which forms the piston rod and a shoe holder portion which slidably holds a periphery of said swash plate, the two parts being united through press-fitting or screw connection.

6. A variable displacement swash plate type compressor comprising:

a cylindrical casing having a plurality of cylinders circumferentially arranged therein;

a plurality of pistons incorporated with the cylinders respectively, each piston including a piston head slidably disposed in the corresponding cylinder, a cylindrical piston rod extending from an eccentric part of the piston head and a swash plate holding portion formed at a leading end of said piston rod;

a drive shaft coaxially extending in said casing;

a swash plate axially movably disposed on said drive shaft and inclinable relative to said drive shaft;

means for causing said swash plate to wobble about the axis of said drive shaft when said drive shaft is rotated about the axis;

means for slidably connecting said swash plate holding portion with a periphery of said swash plate thereby to reciprocate each piston when said swash plate wobbles;

a coil spring disposed about said drive shaft to bias said swash plate toward said cylinders; and a supporting plate fixedly positioned in said casing in a manner to define a crank chamber in which said swash plate, said coil spring and said swash plate holding portion are placed, said supporting plate having circular openings through which the cylindrical piston rods of the pistons slidably pass respectively, wherein a center axis of the piston rod of each piston is positioned radially outside of a center axis of a corresponding cylinder with respect to a longitudinal axis of the drive shaft to prevent the piston rod from rotating.

7. A variable displacement swash plate type compressor comprising:

a cylindrical casing having a plurality of cylinders circumferentially arranged therein;

a plurality of pistons incorporated with the cylinders respectively, each piston including a piston head slidably disposed in the corresponding cylinder, a cylindrical piston rod extending from an eccentric part of the piston head and a swash plate holding portion formed a leading end of said piston rod;

a drive shaft coaxially extending in said casing;

a swash plate axially movably disposed on said drive shaft and inclinable relative to said drive shaft;

means for causing said swash plate to wobble about the axis of said drive shaft when said drive shaft is rotated about the axis;

means for slidably connecting said swash plate holding portion with a periphery of said swash plate thereby to reciprocate each piston when said swash plate wobbles;

a first coil spring disposed about said drive shaft to bias said swash plate toward said cylinders;

a second coil spring disposed about said drive shaft to bias said swash plate in a direction away from said cylinders; and a supporting plate fixedly positioned in said casing in a manner to define a crank chamber in which said swash plate, said swash plate holding portion and said first and second coil springs are placed, said supporting plate having circular openings through which the cylindrical piston rods of the pistons slidably pass respectively, wherein a center axis of the piston rod of each piston is positioned radially outside of a center axis of a corresponding cylinder with respect to a longitudinal axis of the drive shaft to prevent the piston rod from rotating.

* * * * *